US005799635A

United States Patent [19]

Aljabari

[11] Patent Number: 5,799,635

[45] Date of Patent: Sep. 1, 1998

[54] TWO CYCLE ENGINE HAVING A DECOMPRESSION SLOT

[75] Inventor: Samer Aljabari, Virginia Beach, Va.

[73] Assignee: Ryobi North America, Anderson, S.C.

[21] Appl. No.: 898,049

[22] Filed: Jul. 22, 1997

Related U.S. Application Data

[60] Provisional application No. 60/022,617 Jul. 26, 1996.

[51] Int. Cl.[6] ..... F02B 33/12

[52] U.S. Cl. ..... 123/182.1; 123/65 A

[58] Field of Search ..... 123/182.1, 65 A, 123/73 PP, 65 P

[56] References Cited

U.S. PATENT DOCUMENTS

| | | | |
|---|---|---|---|
| 3,881,454 | 5/1975 | Jaulmes . | |
| 4,252,092 | 2/1981 | Kaufman et al. . | |
| 4,312,308 | 1/1982 | Slattery . | |
| 4,450,794 | 5/1984 | Pailler | 123/74 R |
| 4,993,372 | 2/1991 | Mott et al. . | |
| 5,054,441 | 10/1991 | Nakatani et al. . | |
| 5,072,699 | 12/1991 | Pien . | |
| 5,361,738 | 11/1994 | Iida | 123/182.1 |
| 5,375,570 | 12/1994 | Swain . | |
| 5,377,642 | 1/1995 | Morrow et al. | 123/182.1 |
| 5,425,346 | 6/1995 | Mavinahally . | |

*Primary Examiner*—David A. Okonsky
*Attorney, Agent, or Firm*—Brooks & Kushman P.C.

[57] ABSTRACT

A two-cycle engine having an enclosed crankcase assembly and a cylinder assembly. A cylinder wall is sized to sealingly cooperate with the piston as it reciprocates relative thereto. The cylinder assembly is provided with an exhaust port in a first plane and a pair of diametrically opposed recessed transfer ports positioned in a second plane along the cylinder axis. The cylinder assembly is provided with a pair of decompression slots each formed in the cylinder wall in communication with one of the opposed transfer ports and extending towards the combustion chamber end of the cylinder assembly. The decompression slots having a circumferential width W which is substantially constant and a radially measured depth D which varies generally linearly from a maximum depth at the intersection of the decompression slot and the transfer port to a minimum depth at the uppermost end of the decompression slot.

8 Claims, 1 Drawing Sheet

TWO CYCLE ENGINE HAVING A DECOMPRESSION SLOT

RELATED CASES

This application claims the benefit of provisional application Ser. No. 60/022,617 filed Jul. 26, 1996.

TECHNICAL FIELD

This invention relates to a two-cycle engine having a compression release mechanism and more specifically, to two-cycle engines having a decompression slot formed in the cylinder wall.

BACKGROUND

Internal combustion engines and other small high compression engines require a large cranking torque in order to start the engine. This can be especially difficult to do during cold starts.

Various mechanisms have been developed in order to provide compression relief to ease starting such as relief valves, decompression ports extending into the chamber, and in the case of two cycle engines, decompression slots extending upward along the cylinder wall from an intake or transfer port.

U.S. Pat. No. 5,054,441 to Nakatani et. al., discloses a decompression device in a two cycle engine which includes a triangular decompression groove formed in the cylinder wall. The grooves are arranged with curved flared sides which extend from the base ends of the grooves. This arrangement requires a high tolerance during casting or machining in order to be effective.

It is therefore an object of the present invention to produce a compression release mechanism which is insensitive to variations made during machining and will perform without sacrificing emissions, power, or fuel consumption.

DETAILED DESCRIPTION OF THE INVENTION

Figure 1:
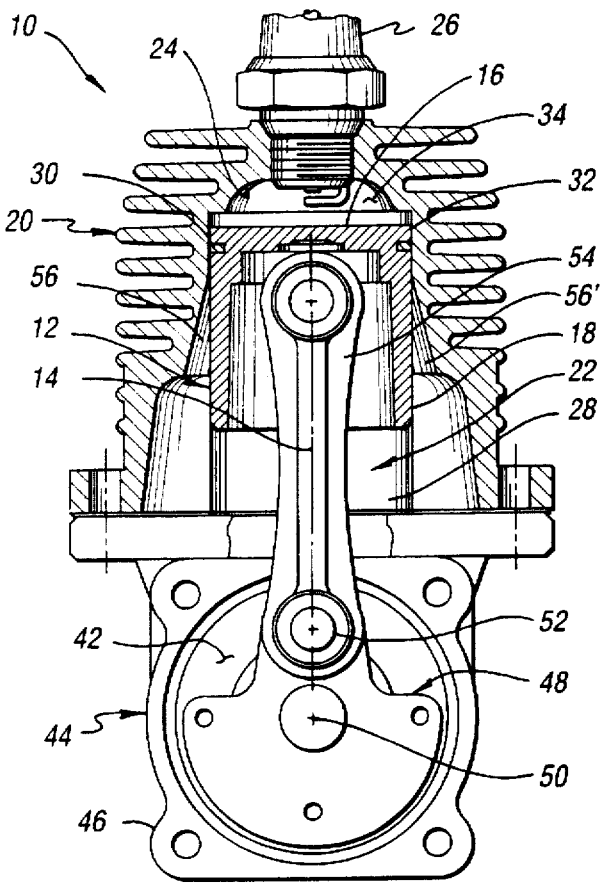
FIG. 1 shows a cross-section of the engine as a whole.

Referring to FIGS. 1–5, a two-cycle internal combustion engine 10 is shown utilizing the present invention. Two-cycle engine 10 is provided with a piston 12 which is reciprocal along a cylinder axis 14. The piston 12 is generally cylindrically shaped having a top 16 and a circumferential wall 18.

Piston 12 reciprocates within a cylinder assembly 20 having an internal cylindrical cavity 22 aligned along cylinder axis 14. Cylindrical cavity 22 is provided with an enclosed end 24 containing sparkplug 26 and a cylindrical wall 28 sized to sealingly cooperate with piston 12. Piston 12 is further provided with a conventional piston ring 30 to help seal circumferential wall 18 of piston 12 to cylindrical wall 28 of the cylinder assembly 20. In the embodiment shown, a single piston ring 30 is utilized, however, two or more piston rings can be used to further aid in sealing.

The peripheral edge of piston top 16 is preferably chamfered in order to reduce the distance between top of piston ring 30 and the corner 32 of piston 12. Cylindrical cavity 22 and the top 16 of piston 12 collectively define a combustion chamber 34 which varies in volume as the piston 12 reciprocates. The cylinder assembly 20 illustrated, has a pair of exhaust ports 36 and 36', however, a single port or a greater number of ports could alternatively be used. Exhaust ports 36 and 36' extend through cylinder wall 28 and combine to form exhaust passageway 38. Located below the exhaust port 36 on diametrically opposed opposite sides of cylindrical cavity 22 are a pair of transfer ports 40 and 40' which extend radially outward from cylinder axis 14 into the cylinder wall 28. Transfer ports 40 and 40' form a passageway between combustion chamber 34 and internal crank case chamber 42 when piston 12 is near the bottom most portion of its reciprocal travel (Bottom Dead Center, BDC).

Cylinder assembly 20 mounts upon enclosed crank case assembly 44 as illustrated in FIG. 1. Enclosed crank case assembly 44 is made up of a housing 46 which defines internal crank case chamber 42. A crankshaft 48 is pivotally supported relative to the housing 46 for rotation about a crankshaft axis 50 which is generally perpendicular to cylinder axis 14. Crankshaft 48 includes a crankpin 52 which is radially offset from crankshaft axis 50. A connecting rod 54 is pivotally connected to and extends between crankpin 52 and piston 12 in a conventional manner.

Figure 5:
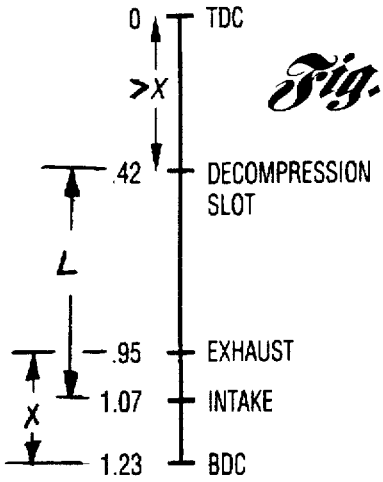
FIG. 5 shows the relative vertical arrangement of the ports and the piston at TDC and BDC.
Figure 4:
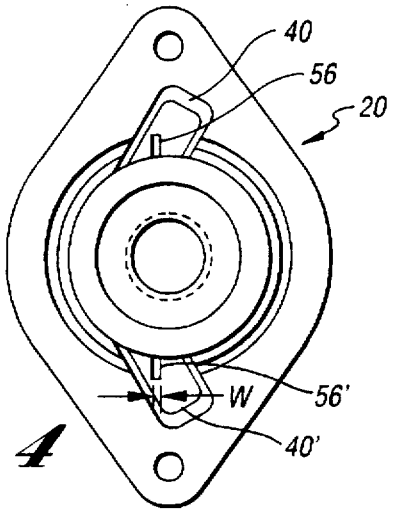
FIG. 4 is a cross-section of FIG. 3 showing details of the transfer ports.
Figure 2:
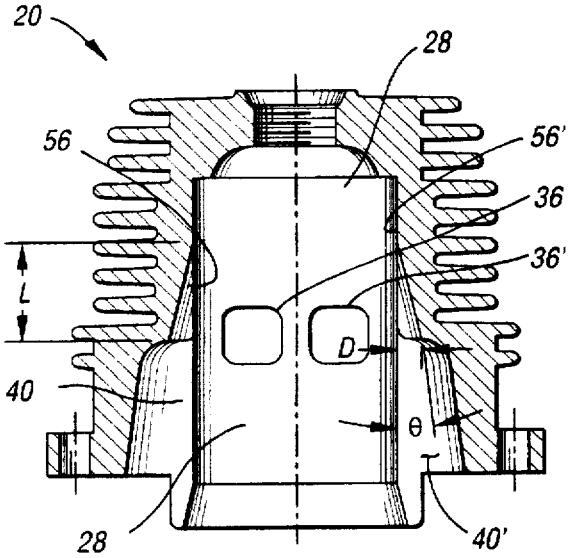
FIG. 2 shows a cross-section of the cylinder assembly.
Figure 3:
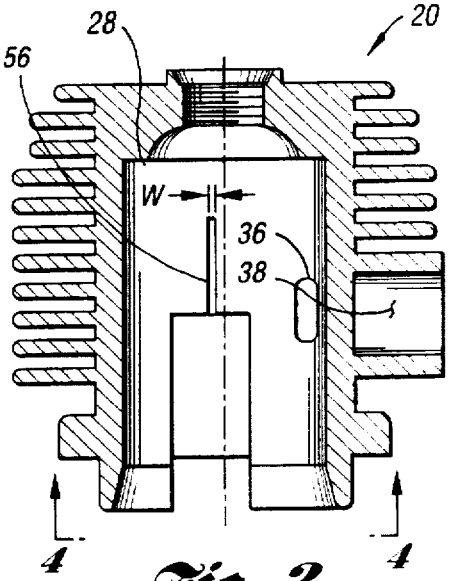
FIG. 3 shows a cross-section of the cylinder assembly perpendicular to the cross-section of FIG. 2.

In operation, as the piston 12 reciprocates within the cylinder assembly 20, corner 32 of piston 12 moves from the top dead center position (TDC), shown in FIG. 1, to a bottom dead position in which the piston 12 is at its lower most part of its travel. In the preferred embodiment described, engine 10 has a cylinder bore diameter of 1.32 inches (35 mm) and a piston stroke of 1.22 inches (32.5 mm). The orientation of the top of the exhaust port 36 and the top of the transfer port 40 relative to corner 32 of the piston 12 as the piston 12 moves between TDC and BDC is shown in FIG. 5.

As the engine 10 operates, combustion is initiated shortly before the piston 12 reaches top dead center. As the air fuel mixture burns, the chamber pressure rises accordingly, forcing the piston 12 down. As corner 32 of the piston 12 clears the top of the exhaust port 36, the cylinder pressure dramatically drops as exhaust is discharged through exhaust ports 36 and 36' into exhaust passageway 38. As illustrated in FIG. 5, the piston 12 is a distance X, approximately 0.95 inches above bottom dead center before the corner 32 of piston 12 clears the uppermost portion of exhaust port 36. As the piston 12 continues to move downward, corner 32 of piston 12 will clear the uppermost portion of transfer ports 40 and 40', at which time, fuel/air mixture from within internal crankcase chamber 42 is allowed to flow through transfer ports 40 and 40' into combustion chamber 34. As the crankshaft 48 continues to turn, piston 12 will begin to move upward sequentially, sealing off transfer port 40 and exhaust port 36, compressing the fuel/air mixture as the enclosed volume of the combustion chamber 34 diminishes, whereupon the sparkplug 26 will ignite the mixture and the cycle will begin again.

In small engines of the type illustrated, cranking load which is expended when the operator is starting the engine is an important consideration. In manual start engines, in which the operator pulls a starter cord, it is desirable to minimize the pull effort required. In electric start engines, it is desirable to minimize the cranking load to extend battery life and minimize starter motor size. Various mechanisms have been used in order to provide compression relief to ease starting. People have used operator activated relief valves, decompression ports extending through the cylinder wall into the exhaust passageway, and decompression slots extending upward along the cylinder wall from an intake or transfer port.

The present engine 10, utilizes novel decompression slots 56 and 56' which extend along cylinder wall 28 from the top of transfer ports 40 and 40' toward the enclosed end 24 of cylindrical cavity 22. In the engine illustrated, the decompression slots 56 and 56' have an axial length L which is approximately one-half of the cylinder bore and about two times distance X. Preferably, decompression slots 56 and 56' have a length L which is 40% to 60% of the bore diameter and 1.5 to 2.5 times distance X. In the embodiment illustrated, the decompression slots are approximately 0.65 inches long. Decompression slots 56 and 56' have a substantially uniform circumferential width W which in the embodiment illustrated, is approximately 0.050 inches. Decompression slots 56 and 56' have a radially measured depth D which varies linearly from a maximum depth at the intersection of the decompression slot 56 and transfer port 40 to a minimum depth at the uppermost end of the slot. Preferably, the depth of the slot varies linearly relative to cylinder axis 14 by 10° to 15° and most preferably, 13° as illustrated by angle θ in FIG. 2.

Decompression slots 56 and 56' are quite large relative to decompression slots of the prior art and are very effective at reducing cranking force. The present engine 10 has a cranking force which is approximately one-half of the cranking force without the decompression slots 56 and 56'. Not only is cranking force reduced, but hydrocarbon and carbon monoxide (HC and CO) emissions are reduced while horsepower is maintained. A number of test engines have, in fact, experienced a slight improvement in horsepower, although the increase may not be statistically significant.

As previously noted, the transfer slots are relatively large when compared to piston area. In the preferred embodiment, the piston area is 1.37 sq. inches. The decompression slot area at the intersection of the decompression slot 56 and the transfer port 40 is approximately 0.016 sq. inches or 1.16% of the piston area. Midway along the length of the decompression slot 56, due to the linearly varying depth of the decompression slot 56, the combined decompression slot area is 0.008 sq. inches or approximately 0.58% of the piston area. In order to practice the present invention, it is believed that the decompression slot area should be maintained between 0.25 and 1% of the piston cross-sectional area at the center of the decompression slot 56 i.e. midway between the intersection of the decompression slot 56 and the transfer port 40 and the uppermost end of the decompression slot.

Decompression slot 56 of the present invention is quite long, i.e. it extends a significant length up the cylinder wall 28 in the direction of enclosed end 24 of cylindrical cavity 22. Preferably, the uppermost end of decompression slot 56 and 56' is spaced from the top corner of the piston 12 at TDC less than one-half of the distance between the top corner of the piston 12 at TDC and the top of the transfer port 40. Preferably, the top of the decompression slot 56 is 0.35 to 0.45 inches high from the top corner of the piston 12 at the TDC. In the preferred embodiment illustrated, when the piston 12 is at TDC, the top corner of the piston 12 is spaced 0.42 inches above the uppermost end of the decompression slot and 1.07 inches from the uppermost end of transfer port 40.

Decompression slots 56 and 56' have a relatively narrow width W, which preferably between 0.040 and 0.060 inches for an engine having a piston diameter of between 1 and 1.5 inches. The transfer slot must be sufficiently narrow to quench the flame when the piston 12 is moving downward, in order to prevent the flame from reaching the air/fuel mixture within transfer slots 40 and 40'. It should be appreciated that decompression slots 56 and 56' can significantly affect the exhaust emissions by increasing internal exhaust gas recirculation, i.e. exhaust residual mixes with the incoming air/fuel charge. The exhaust residual acts as diluent which affects the combustion process, particularly at low speeds when the decompression slots have their greatest affect on engine performance.

While the best mode for carrying out the invention has been described in detail, those familiar with the art to which this invention relates will recognize various alternative designs and embodiments for practicing the invention as defined by the following claims.

What is claimed is:

1. A two-cycle internal combustion engine comprising:

a cylindrically shaped piston reciprocal along a cylinder axis, the piston having a top and a circumferential wall;

an enclosed crankcase assembly having a housing defining an internal crankcase chamber, a crankshaft pivotally supported relative to the housing for rotation about a crankshaft axis generally perpendicular to the cylinder axis, the crankshaft including a crankpin which is radially offset from the crankshaft axis, and a connecting rod pivotally connected to and extending between the crankpin and the piston;

a cylinder assembly, mounted upon the enclosed crankcase assembly, having an internal cylindrical cavity aligned with the cylinder axis with an enclosed end containing a spark plug and a cylinder wall sized to sealingly cooperate with the piston as it reciprocates relative thereto, the cylindrical cavity and the top of the piston collectively defining a combustion chamber which varies in volume as the piston reciprocates between top dead center (TDC) and bottom dead center (BDC), the cylinder assembly being provided with an exhaust port extending through the cylinder wall and opening into the cylinder cavity a distance X from the top of the piston at BDC, a pair of generally diametrically opposed recessed transfer ports each formed in the cylinder wall extending between the enclosed crankcase and an upper most location spaced from the top of the piston at BDC, a distance less than X;

wherein the cylinder assembly is provided with a pair of decompression slots each formed in the cylinder wall in communication with one of the opposed transfer ports and extending from the uppermost end of the transfer port toward the enclosed end of the cylindrical cavity and terminating at a point spaced from the top of the cylindrical cavity, the decompression slots each having circumferential width W which is substantially constant and a radially measured depth D which varies generally linearly from a maximum depth at the intersection of the decompression slot and the transfer port to a minimum depth at the uppermost end of the decompression slot.

2. The engine of claim 1 wherein the decompression slots collectively have a cross-sectional area measured along a plane perpendicular to the cylinder axis and oriented at the center of the decompression slot which is 0.25 to 1.0% of the cross-sectional area of the cylindrical cavity.

3. The engine of claim 1 wherein the decompression slot has an axial length which is approximately one half of the diameter of the cylinder bore.

4. The engine of claim 1 wherein the depth varies linearly relative to the cylinder axis by 10 to 15 degrees.

5. The engine slot of claim 1 wherein the uppermost end of the decompression slot is spaced from the top corner of the piston at TDC less than one half of the distance between the top corner of the piston at TDC and the top of the transfer port.

6. The engine slot of claim 1 wherein the top of the decompression slot is 0.35 to 0.45 inches below the top corner of the piston at the TDC.

7. The engine of claim 1 wherein the decompression slot has a width is between 0.04 and 0.06 inches for and engine having a piston diameter of between 1 and 1.5 inches.

8. The engine of claim 1 wherein the decompression slot has a length L which is about two times distance X.

* * * * *